United States Patent [19]

Pomfret

[11] 3,958,692

[45] May 25, 1976

[54] SHAVING SYSTEM

[75] Inventor: Edward E. Pomfret, Newbury, England

[73] Assignee: The Gillette Company, Boston, Mass.

[22] Filed: Dec. 26, 1974

[21] Appl. No.: 536,484

Related U.S. Application Data

[62] Division of Ser. No. 381,768, July 23, 1973.

[30] Foreign Application Priority Data

July 25, 1972 United Kingdom..... 34715/72
July 25, 1972 United Kingdom..... 34716/72
July 25, 1972 United Kingdom..... 34717/72

[52] U.S. Cl...... 206/359; 30/50; 30/90; 206/228; 206/354

[51] Int. Cl.[2]..... B65D 83/10

[58] Field of Search..... 206/359, 228, 354; 30/90, 50

[56] References Cited

UNITED STATES PATENTS 2,695,448 11/1954 Cavanaugh ..... 30/90

*Primary Examiner*—William T. Dixson, Jr.

[57] ABSTRACT

A disposable blade unit for a safety razor comprises a thin, transversely flexible blade which is apertured along its lonitudinal center line and has its two longitudinal edges parallel and sharpened to cutting edges. A pair of blade strips each having a length substantially equal to that of the blade and a width less than half that of the blade and each sharpened along one longitudinal edge only are secured symmetrically on opposite sides of the longitudinal center line of the blade with their sharpened edges directed outwardly and extending parallel to the sharpened edges of the blade.

7 Claims, 4 Drawing Figures

SHAVING SYSTEM

This application is a division of Ser. No. 381,768, filed July 23, 1973, entitled "Shaving System."

SUMMARY OF INVENTION

This invention relates to shaving systems and more particularly to shaving systems that employ blade units of the tandem edge type.

It is known that very satisfactory shaving results can be obtained by using a shaving system having tandem-acting, spaced, parallel cutting edges arranged to follow one another over the skin.

It would obviously be of great practical convenience if such a tandem-acting cutting edge shaving system could be constituted by inserting a disposable blade unit presenting at least one pair of such tandem-acting cutting edges, into a conventional safety razor frame designed to receive conventional disposable blades. Proposals for such tandem-acting cutting edge blade units have indeed been made in the past, but they have not proved commercially acceptable. This is due in part to the fixed relationships between cap and guard portions of existing razors. The disposition of the previously proposed tandem-acting cutting edge blade units between these elements has proved to be incompatible with optimum geometrical relationships, that is the razor head geometry (the spatial relationship of the two cutting edges and the parts of the razor frame which engage the skin ahead of and behind the cutting edges) has been far from ideal.

The present invention provides a disposable, tandem-acting multiple edge shaving system of the general character above referred to, which gives highly satisfactory shaving results when used with an appropriate razor and whose design is such as to allow of simple and economic manufacture.

In accordance with one aspect of the invention a disposable blade unit for a safety razor comprises a thin, transversely flexible blade which is apertured along its longitudinal center line and has its two longitudinal edges parallel and sharpened to cutting edges, a pair of blade strips each having a length substantially equal to that of the blade and a width less than half that of the blade and each sharpened along one longitudinal edge only, and means securing the two blade strips to the blade with the blade strips disposed symmetrically on opposite sides of the longitudinal center line of the blade with their sharpened edges directed outwardly and extending parallel to the sharpened edges of the blade, the distance between the cutting edge of each blade strip and the longitudinal center line of the blade differing significantly from the distance between each cutting edge of the blade and the said center line.

For optimum shaving results, the tandem-acting cutting edge blade units of the present invention should be used in a razor, the geometry of whose head differs somewhat from that of a razor designed for use with conventional double-edged blades. Such razors may be specially manufactured, but alternatively such a razor can be produced by attaching to a conventional safety razor frame a converter device which so modifies the razor head geometry as to render the razor fully suitable for use with the improved tandem-acting cutting edge blade units of the invention.

In accordance with another aspect of the invention there is provided a magazine or dispenser accommodating one or more disposable tandem-acting cutting edge blade units and also carrying detachably at least one converter device which can readily be attached to a conventional safety razor frame to modify the razor head geometry and render the razor fully suitable for use with blade units. The converter device comprises a member of resilient material so shaped and dimensioned that it can be engaged over a guard member of the razor and held thereon by its own elastic contraction with a portion of the member covering the skin-engaging surface of the guard member, so that in use the portion will engage the skin ahead of the tandem cutting edges of the blade unit.

The converter device shown and described is suitable for use with a conventional, commercially available, safety razor and with tandem-acting cutting edge blade units. It will be obvious to those skilled in the art that by appropriate modifications converter devices in accordance with the invention can be made to suit other forms of razor and/or other forms of tandem-acting cutting edge blade units.

Other objects, features and advantages of the invention will be seen as the following description of a particular embodiment progresses in conjunction with the drawings, in which.

DESCRIPTION OF PARTICULAR EMBODIMENT

Figure 1:
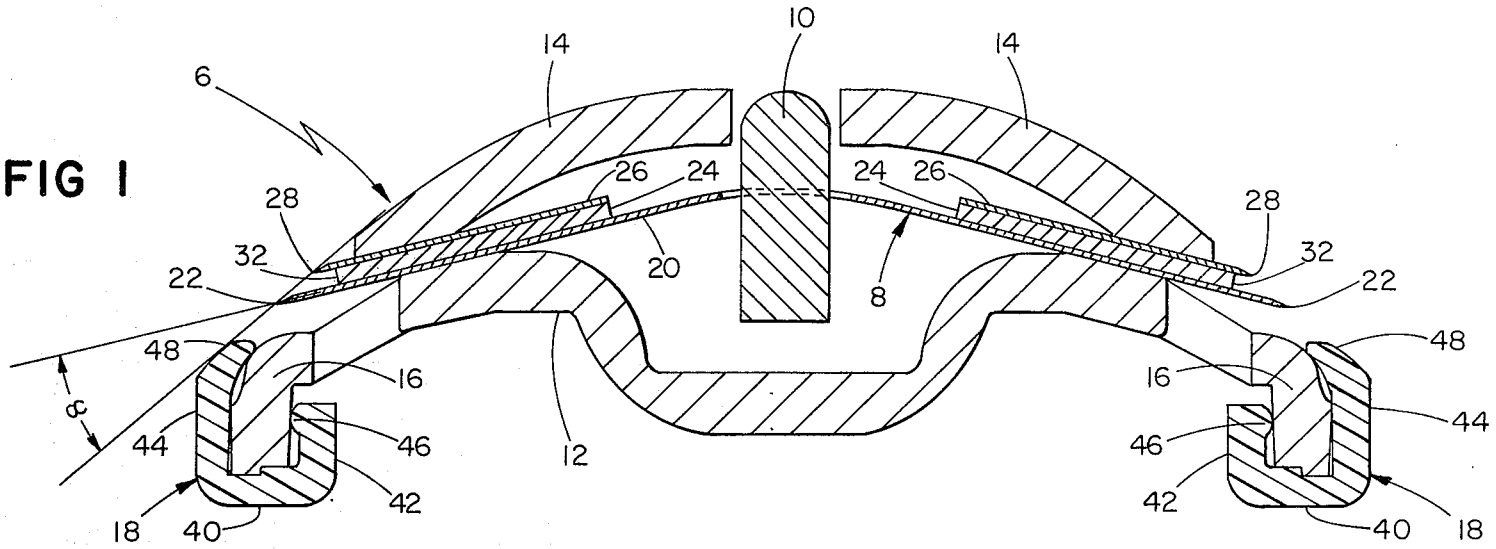
FIG. 1 is a transverse sectional view of parts of a particular commercially available safety razor, designed for use with conventional double-edged razor blades, fitted with a tandem blade unit and with a pair of converter devices.

The safety razor 6, of which parts are shown in FIG. 1, is a commercially available "one-piece" model, designed for use with conventional double-edged disposable blades having a single cutting edge formed on each of the two longitudinal edges of the blade. The razor includes a locating bar 10 for engaging in the slot formed on the longitudinal center line of a conventional blade, a platform 12 on which the blade rests, a two-part cap 14 for clamping the blade against the platform, and a pair of guard members 16 for engaging the skin ahead of the respective cutting edges of the blade. The guard members are fitted with converter devices 18 as described in greater detail hereinafter.

Figure 2:
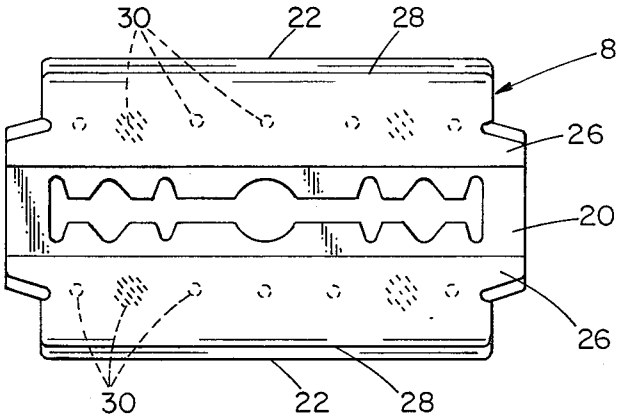
FIG. 2 is a plan view of the blade unit alone.

The improved disposable blade unit 8, shown in FIG. 1 and separately in FIG. 2, comprises a lower blade 20 constituted by a double-edged safety razor blade which is of conventional form and dimensions except that it has an overall width between its opposite cutting edges 22 of from 0.92 to 0.95 inch, which is significantly greater than that of a conventional blade. Secured to the upper face of this blade in the positions indicated in the drawings are a pair of spacer strips 24, each from 0.008 to 0.020 inch in thickness. Secured to the upper face of each spacer member is an upper blade strip 26 having a single sharpened edge 28. The width of the blade strips 26 is not critical; a suitable width is, for example, 0.28 inch. These upper blade strips 26 may conveniently be produced by longitudinal slitting of conventionally manufactured blades similar to that constituting the lower blade 20. The parts 20, 24 and 26 are secured together by spot welding in a plurality of positions as indicated at 30. The cutting edge 28 of each upper blade strip 26 is spaced inwardly from the corresponding cutting edge of the lower blade (measured in a plane parallel to the blades 20 and 26) by from 0.027 to 0.050 inch.

In an alternative embodiment of the blade unit according to the invention, the positions of the double-edged blade and the two single-edged blade strips are reversed, the upper cutting edges 28' being provided by a double-edged blade 20' of conventional shape and size so that it has an overall width between its cutting edges of from 0.860 to 0.868 inch, and the lower cutting edges 22' being provided by two separate single-edged blade strips 26', the relative positions of the cutting edges and the manner of securing together the blade and the blade strips being otherwise as described for the illustrated embodiment. It will be appreciated that in this alternative embodiment of the invention the cutting edge 22' of each blade strip 26' projects outwardly beyond the adjacent cutting edge 28' of the blade 20', that is the cutting edge 22' of each blade strip 26' lies at a greater distance, instead of at a lesser distance, from the longitudinal center line of the blade 20' than does the cutting edge 28' of the blade itself.

The double-edge blade and the single-edge blade strips may be of conventional thickness, for example 0.004 inch, or may be thicker, for example up to 0.010 inch thick. The blade 20 and the blade strips 26 are shown in the illustrated embodiment as being of equal thickness, but they may be of different thicknesses and the combination of a thicker lower blade, for example 0.010 inch thick, and thinner upper blade strips, for example 0.004 inch thick, is advantageous.

In the embodiment illustrated, the outer edge 32 of the spacer 24 is vertical to the blade 20 and the blade strip 26; other configurations of the spacer edge may, however, be used. In particular, it may be wedge-shaped in section tapering towards the cutting edge 22 of the blade 20. In all cases the outer edge 32 of the spacer should be sufficiently set back from the adjacent cutting edge of the blade 20 or the blade strip 26, as the case may be, so as not to overlap the facets of the cutting edge. Where the blade 20 and the blade strips 26 are 0.004 inch thick, the spacer edge 32 should be spaced inwardly from the adjacent cutting edge by at least 0.02 inch and the inward spacing of the spacer edge 32 from the cutting edge 28 of the blade 26 is preferably from 0.02 to 0.03 inch. A greater spacing will usually be required for thicker blades and blade strips.

The spacer 24 may be formed of metal or plastic. If formed of metal, they preferably have the same or a similar composition to the steel of which the blade 20 and the blade strips 26 are formed, for example stainless steel. When the spacers 24 are formed of metal, the parts 20, 24 and 26 are preferably secured together by spot welding, as described above for the illustrated embodiment, and when the spacers are formed of plastic, the parts 20, 24 and 26 are preferably secured together with adhesive which should, of course, be water-resistant.

FIG. 1 also shows the razor fitted with two converter devices 18. Each converter device 18 is constituted by a generally channel-section molding or extrusion of a suitable plastic material, such as acetal resin. The form and dimensions of the converter device are such that the device (a) can readily be engaged over one of the guard members 16 of the razor and will then be held firmly in position thereon by its own elastic contraction, and (b) provides the desired razor head geometry for the cutting edges. In the illustrated embodiment, each converter device has a base 40 and two spaced upstanding walls 42, 44, wall 42 having bead 46 and wall 44 being higher than wall 42 and having an inwardly inclined upper end, the outer surface 48 of which is a skin engaging surface that contributes to the definition of shaving geometry. The relevant parameters of the shaving geometry are (i) the shaving angle, that is the angle between the plane tangent to surface 48 of the converter device 16 and the adjacent cap 14 and the bisector of the blade edge, in this embodiment coincident with the plane of each blade element 20, 26, this being angle $\alpha$ shown in FIG. 1; (ii) the exposures of the cutting edges 22, 28, that is the vertical distance between the cutting edge 22 of the blade 20 and the tangent plane referred to in (i) and the vertical distance between the cutting edge 28 of blade strip 26 and the tangent plane referred to in (i); and (iii) the span, that is the distance between the tangent point of auxiliary guard surface 48 of the converter device 18 and the cutting edge 22 of the blade 20 or the distance between the cutting edges 22, 28 which is in the range of 0.03–0.08 inch.

Figure 4:
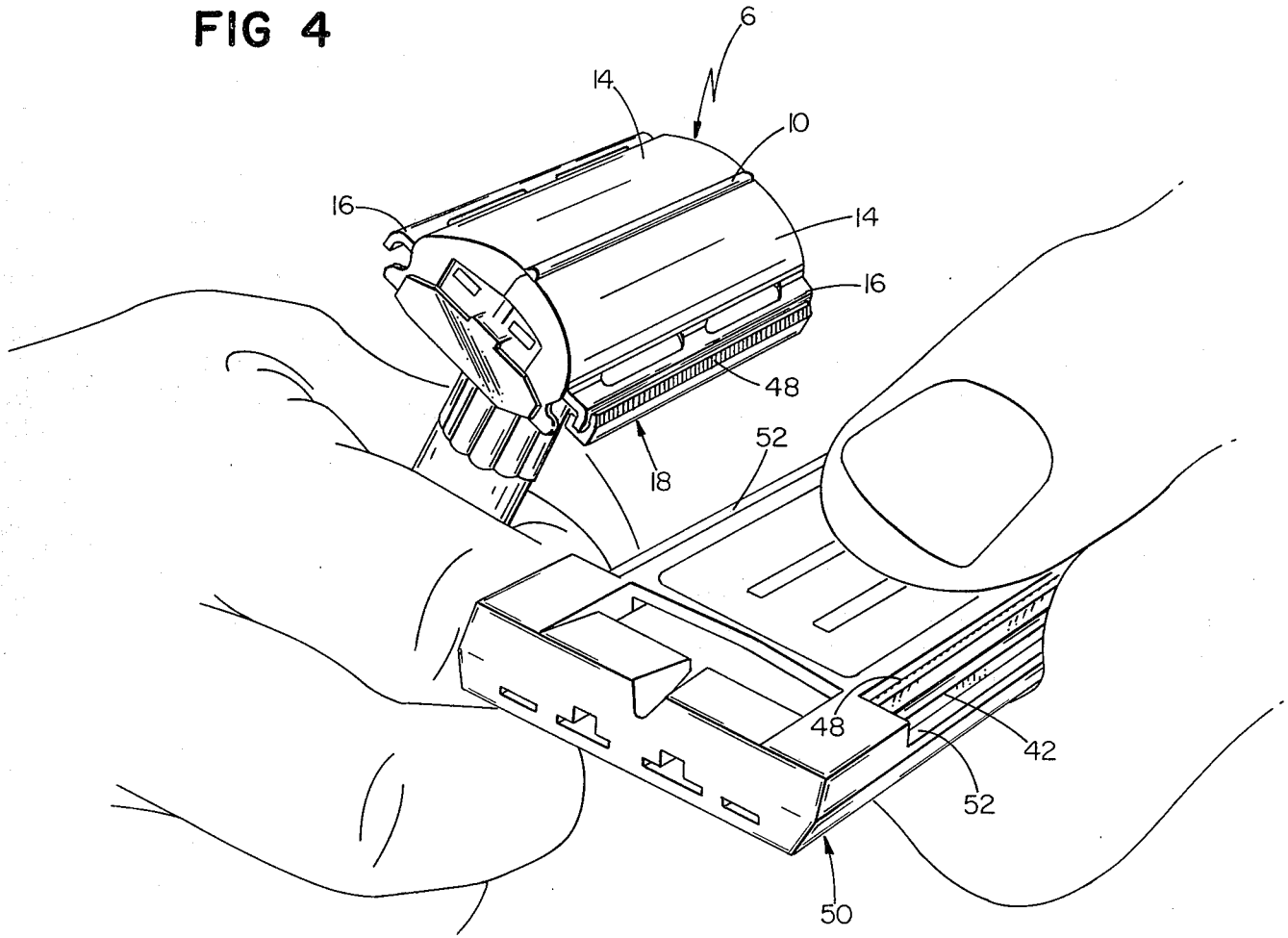
FIG. 4 is a perspective view showing a razor and the dispenser shown in FIG. 3 also adapted to carry detachably a pair of the converter units, one of these being shown in position on the dispenser, while the other is shown already fitted to the razor.

The skin-engaging surface 48 of the converter device 18 may be ridged and grooved, as indicated in FIG. 4, or otherwise contoured as desired. Skin engaging surface 48 of converter 18 is parallel to and spaced outwardly of guard 16 and reduces the effective shaving angle of the system, i.e. converter 18 provides a shaving angle $\alpha$ not greater than the shaving angle provided by the razor with the guard 16 alone.

Figure 3:
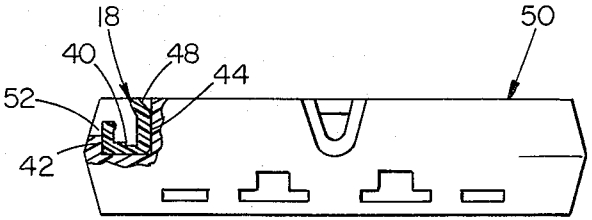
FIG. 3 is an end view, with parts broken away, of a dispenser that carries a plurality of detachable converter devices.

FIGS. 3 and 4 show a dispenser 50 in which one or more of the blade units 8 shown in FIG. 1 may be packaged for supply to the user. Conveniently the dispenser 50 holds a plurality of the units 8 and is constructed to allow the individual units 8 to be dispensed one at a time, a compartment for used and discarded units being also provided in the dispenser. The dispenser illustrated is formed along two opposite edges with a pair of recesses 52 (one of which is shown in section in FIG. 3), each adapted to receive and hold frictionally in position one of the converter devices 18 with the open face of its channel section exposed as indicated in FIG. 3. A user of a standard razor who purchases such a package of tandem-acting cutting edge blade units can readily adapt his razor to allow their use to the best advantage by inserting each of the guard members 16 in turn into one of the devices 18 while it is still held in position on the dispenser and using the razor to move it clear of the dispenser 50. FIG. 4 shows the razor already thus fitted with one of the converter devices 18, the other being still in position on the dispenser 50, but available for fitting to the still exposed guard member 16 of the standard razor.

Since there are many models of conventional safety razors currently in use and on the market, more than one type of converter device may be required in order to adapt all such existing razor models to give optimum shaving performance with the tandem-acting cutting edge blade units described. It is believed that two different types of converter device, differing in certain dimensions, are sufficient to adapt substantially all the safety razors currently in use and another embodiment of the blade unit dispenser is provided with means for carrying detachably two different pairs of converter devices.

While a particular embodiment of the invention has been shown and described, various modifications will be apparent to those skilled in the art and therefore it is not intended that the invention be limited to the disclosed embodiment or to details thereof and departures may be made therefrom within the spirit and scope of the invention as defined in the claims.

What is claimed is:

1. As an article of manufacture and commerce, a package comprising a dispenser formed with a blade unit storage compartment and with razor-converter retaining means, at least one disposable blade unit removably accommodated in said storage compartment, each such blade unit comprising at least one pair of parallel tandem-acting cutting edges formed respectively on a pair of blade members secured together in spaced parallel relation, and at least one razor converter detachably engaged with said retaining means, each such razor converter being shaped and dimensioned to engage over and be retained upon the guard of a safety razor.

2. An article in accordance with claim 1 wherein a plurality of like blade units are removably accommodated in said storage compartment and said dispenser is so constructed as to allow individual blade units to be dispensed one at a time from said compartment.

3. An article in accordance with claim 2 wherein said dispenser is formed additionally with a compartment adapted to receive used blade units.

4. An article in accordance with claim 1 wherein said razor converter retaining means is a recess extending along the length of said package, said recess receiving and holding frictionally in position said razor converter.

5. An article in accordance with claim 4 wherein said razor converter frictionally held in said recess is a member of resilient material so shaped and dimensioned that it can be engaged over a guard member of the razor and held thereon by its own elastic contraction with an auxiliary guard portion of the said member covering the skin-engaging surface of the guard member, so that in use the said portion will engage the skin ahead of the tandem cutting edges of the blade unit.

6. An article in accordance with claim 5 wherein said converter frictionally held in said recess is a channel shaped member having a base, and said auxiliary guard portion extends upwardly from said base and includes a guard surface at its upper end, said auxiliary guard portion, in use, providing a shaving angle $\alpha$ with tandem cutting edge blade units that is not greater than the shaving angle provided by the guard member alone with a conventional razor blade.

7. An article in accordance with claim 6 wherein said disposable blade unit in said storage compartment comprises a thin, transversely flexible blade which is apertured along its longitudinal center line and has its two longitudinal edges parallel and sharpened to cutting edges, a pair of blade strips each having a length substantially equal to that of the blade and a width less than half that of the blade and each sharpened along one longitudinal edge only, and means securing the two blade strips to the blade with the blade strips disposed symmetrically on opposite sides of the longitudinal center line of the blade with their sharpened edges directed outwardly and extending parallel to the sharpened edges of the blade, the distance between the cutting edge of each blade strip and the longitudinal center line of the blade differing significantly from the distance between each cutting edge of the blade and the said center line, said dispenser allowing said blade unit to be dispensed from said compartment.

* * * * *